US007663484B1

(12) United States Patent
Willms et al.

(10) Patent No.: US 7,663,484 B1
(45) **Date of Patent: *Feb. 16, 2010**

(54) REPORTING AND ELIMINATING DETECTED ACTIVE THREATS WHILE IN TRANSIT

(75) Inventors: Paul Henry Willms, Everett, WA (US); James H. Stanley, Palo Alto, CA (US)

(73) Assignee: Erudite, Inc., Tacoma, WA (US)

( * ) Notice: Subject to any disclaimer, the term of this patent is extended or adjusted under 35 U.S.C. 154(b) by 279 days.

This patent is subject to a terminal disclaimer.

(21) Appl. No.: 11/708,366

(22) Filed: Feb. 19, 2007

Related U.S. Application Data

(63) Continuation-in-part of application No. 11/025,447, filed on Dec. 27, 2004, now Pat. No. 7,180,418.

(51) Int. Cl.
*G08B 13/14* (2006.01)

(52) U.S. Cl. ..... 340/568.1; 340/541; 340/539.26; 340/870.16

(58) Field of Classification Search ..... 340/568.1, 340/541, 565, 567, 517, 521–522, 539.29, 340/539.26, 506, 870.01, 870.16
See application file for complete search history.

(56) References Cited

U.S. PATENT DOCUMENTS 6,295,860 B1 * 10/2001 Sakairi et al. ..... 73/23.41
6,610,977 B2 * 8/2003 Megerle ..... 250/287
6,797,944 B2 * 9/2004 Nguyen et al. ..... 250/286
7,047,861 B2 * 5/2006 Solomon ..... 89/1.11
7,106,244 B2 * 9/2006 Hsu ..... 342/27
7,394,381 B2 * 7/2008 Hanson et al. ..... 340/572.4
7,422,175 B1 * 9/2008 Bobinchak et al. ..... 244/3.15
2005/0179545 A1 * 8/2005 Bergman et al. ..... 340/545.2
2005/0248456 A1 * 11/2005 Britton et al. ..... 340/539.29
2006/0097171 A1 * 5/2006 Balchunas et al. ..... 250/336.1
2007/0096037 A1 * 5/2007 Shapiro et al. ..... 250/394

* cited by examiner

*Primary Examiner*—Daniel Previl
(74) *Attorney, Agent, or Firm*—Boris G. Tankhilevich

(57) ABSTRACT

A method for reporting at least one detected active threat to the homeland security (HS). Each threat is either hidden inside at least one cargo container before transit, or is placed inside at least one cargo container while in transit. Each threat while interacting with its surrounding generates a unique threat signature. The method comprises; (A) substantially continuously probing each cargo container; (B) detecting at least one threat signature;—(C) processing each detected threat signature to determine a likelihood of at least one threat to become a threat to HS;—(D) identifying at least one said container that includes such threat to HS;—(E) reporting to at least one Homeland Security Monitoring Center (HSMC) that at least one container includes at least one such threat to HS; and receiving instructions from at least one Homeland Security Monitoring Center (HSMC) how to eliminate at least one such reported threat to HS while in transit; and—(F) using robotic means to eliminate at least one such detected threat to HS.

20 Claims, 1 Drawing Sheet

REPORTING AND ELIMINATING DETECTED ACTIVE THREATS WHILE IN TRANSIT

This is a continuation-in-part of the patent application entitled "ACTIVE THREAT DETECTION AND ELIMINATION WHILE IN TRANSIT", U.S. Ser. No. 11/025,447, filed on Dec. 27, 2004 now U.S. Pat. No. 7,180,418.

BACKGROUND OF THE INVENTION

1. Field of the Invention

The present invention relates to the field of threat detection and identification, and more specifically, to the field of active detection, identification, communication of threats hidden inside cargo shipments and elimination of such threats while in transit.

2. Discussion of the Prior Art

The patent application entitled "ACTIVE THREAT DETECTION AND ELIMINATION WHILE IN TRANSIT", U.S. Ser. No. 11/025,447, is hereafter referred to as the patent application #1. The patent application #1 is incorporated herein in its entirety.

The patent application #1 was directed to a method of active detection of at least one threat to the homeland security (HS). Each such threat was assumed to be either hidden inside at least one cargo container before transit, or to be placed inside at least one cargo container while in transit. Each such threat while interacting with its surrounding was assumed to generate a unique threat signature.

However, the patent application #1 did not address the issue of reporting each such threat to HS to at least one Homeland Security Monitoring Center (HSMC).

SUMMARY OF THE INVENTION

The present invention addresses the issue of reporting each such threat to HS to at least one Homeland Security Monitoring Center (HSMC).

One aspect of the present invention is directed to a method for reporting at least one detected active threat to the homeland security (HS), wherein each threat is either hidden inside at least one cargo container before transit, or is placed inside at least one cargo container while in transit. Each such threat while interacting with its surrounding generates a unique threat signature.

In one embodiment, the method of the present invention comprises: (A) substantially continuously probing each cargo container; (B) detecting at least one threat signature; (C) processing each detected threat signature to determine a likelihood of at least one threat to become a threat to HS; (D) identifying at least one container that includes such threat to HS; (E) reporting to at least one Homeland Security Monitoring Center (HSMC) that at least one container includes at least one threat to HS; and receiving instructions from at least one Homeland Security Monitoring Center (HSMC) how to eliminate at least one reported threat to HS while in transit; and (F) using robotic means to eliminate such at least one detected threat to HS.

In one embodiment of the present invention, the step (E) further comprises: (E1) processing a set of threat data generated by each threat to HS; wherein the set of threat data includes position coordinates of each container including at least one threat to HS; (E2) generating a threat report derived from the set of threat data; (E3) sending the threat report to at least one Homeland Security Monitoring Center (HSMC); and (E4) receiving a set of instruction from at least one Homeland Security Monitoring Center (HSMC) how to eliminate at least one such detected threat to HS.

In one embodiment of the present invention, the step (E1) further comprises: (E1, 1) determining position coordinates of at least one container including at least one threat to HS by using a radio positioning system; wherein the radio positioning system is selected from the group consisting of: {GPS; GLONASS; and Global Navigational Satellite System (GNSS)}.

In one embodiment of the present invention, the step (E3) further comprises: (E3, 1) using a first cellular communication node configured to initiate a transmission of a message containing the threat report; and (E3, 2) using a second cellular communication node configured to receive the message and to forward the message to a router for subsequent forwarding via at least one additional communication link to at least one Homeland Security Monitoring Center (HSMC).

In one embodiment of the present invention, the step (E3, 1) further comprises: (E3, 1, 1) using a message that contains an identifier and a destination address.

In one embodiment of the present invention, the step (E3, 1) further comprises: (E3, 1, 2) placing the first cellular communication node on board of the container ship.

In one embodiment of the present invention, the step (E3, 2) further comprises: (E3, 2, 1) using the router to access at least one additional communication link for forwarding the message to at least one Homeland Security Monitoring Center (HSMC) via the Internet.

In one embodiment of the present invention, the step (E3, 2) further comprises: (E3, 2, 2) selecting at least one additional communication link from the group consisting of: {a direct link to the Internet; a satellite link to the Internet; and a private radio link to the Internet}.

In one embodiment of the present invention, the step (E3, 2, 2) further comprises: (E3, 2, 2, 1) selecting a direct link to the Internet from the group consisting of: {a dial-up terrestrial telephone link; a DSL terrestrial telephone link; and a cable TV terrestrial data link}.

In one embodiment of the present invention, the step (E3, 2, 2) further comprises: (E3, 2, 2, 2) using a satellite link to the Internet; wherein the satellite link to the Internet further includes: a first transmitter/receiver configured to up link the message to a satellite, and a second transmitter/receiver; wherein the second transmitter/receiver is configured to down link the received message from the satellite to the Internet.

In one embodiment of the present invention, the step (E3, 2, 2, 2) further comprises: (E3, 2, 2, 2, 1) selecting the satellite from the group consisting of: {an Inmarsat satellite; a Low Earth-Orbiting Communications Satellite (LEO); and a Geosynchronous Communications Satellite (GEO)}.

In one embodiment of the present invention, the step (E3, 2) further comprises: (E3, 2, 3) placing the second cellular communication node on board of the container ship.

In one embodiment of the present invention, the step (E3, 2) further comprises: (E3, 2, 4) using the second cellular communication node that is located within operating range of a port or harbor.

In one embodiment of the present invention, the step (E3, 2) further comprises: (E3, 2, 5) using the second cellular communication node that is a part of a data cellular network.

In one embodiment of the present invention, the step (E3, 2) further comprises: (E3, 2, 6) using the second cellular communication node that is a part of a voice/data cellular network.

Another aspect of the present invention is directed to a system for reporting at least one detected active threat to the homeland security (HS). Each such threat is either hidden inside at least one cargo container before transit, or is placed inside at least one cargo container while in transit. Each such threat while interacting with its surrounding generates a unique threat signature.

In one embodiment, the system of the present invention comprises: (A) a means for substantially continuously probing each cargo container; (B) a means for detecting at least one threat signature; (C) a means for processing each detected threat signature to determine a likelihood of at least one threat to become a threat to HS; (D) a means for identifying at least one container that includes the threat to HS; (E) a means for reporting to at least one Homeland Security Monitoring Center (HSMC) that at least one container includes at least one threat to HS; and receiving instructions from at least one Homeland Security Monitoring Center (HSMC) how to eliminate at least one reported threat to HS while in transit; and (F) a robotic means for eliminating at least one detected threat to HS.

In one embodiment of the present invention, the means (E) further comprises: (E1) a means for a processing a set of threat data generated by each threat to HS; wherein the set of threat data includes position coordinates of each container including at least one threat to HS; (E2) a means for generating a threat report derived from the set of threat data; (E3) a means for sending the threat report to at least one Homeland Security Monitoring Center (HSMC); and (E4) a means for receiving a set of instruction from at least one Homeland Security Monitoring Center (HSMC) how to eliminate at least one detected threat to HS.

In one embodiment of the present invention, the means (E1) further comprises: (E1, 1) a radio positioning system configured to determine position coordinates of at least one container including at least one detected threat to HS; wherein the radio positioning system is selected from the group consisting of: {GPS; GLONASS; and a Global Navigational Satellite System (GNSS)}.

In one embodiment of the present invention, the means (E3) further comprises: (E3, 1) a first cellular communication node configured to initiate a transmission of a message containing the threat report; and (E3, 2) a second cellular communication node configured to receive the message and to forward the message to a router for subsequent forwarding via at least one additional communication link to at least one Homeland Security Monitoring Center (HSMC).

In one embodiment of the present invention, the additional communication link is selected from the group consisting of: {a direct link to the Internet; a satellite link to the Internet; and a private radio link to the Internet}.

BRIEF DESCRIPTION OF DRAWINGS

The aforementioned advantages of the present invention as well as additional advantages thereof will be more clearly understood hereinafter as a result of a detailed description of a preferred embodiment of the invention when taken in conjunction with the following drawings.

DETAILED DESCRIPTION OF THE PREFERRED AND ALTERNATIVE EMBODIMENTS

Figure 1:
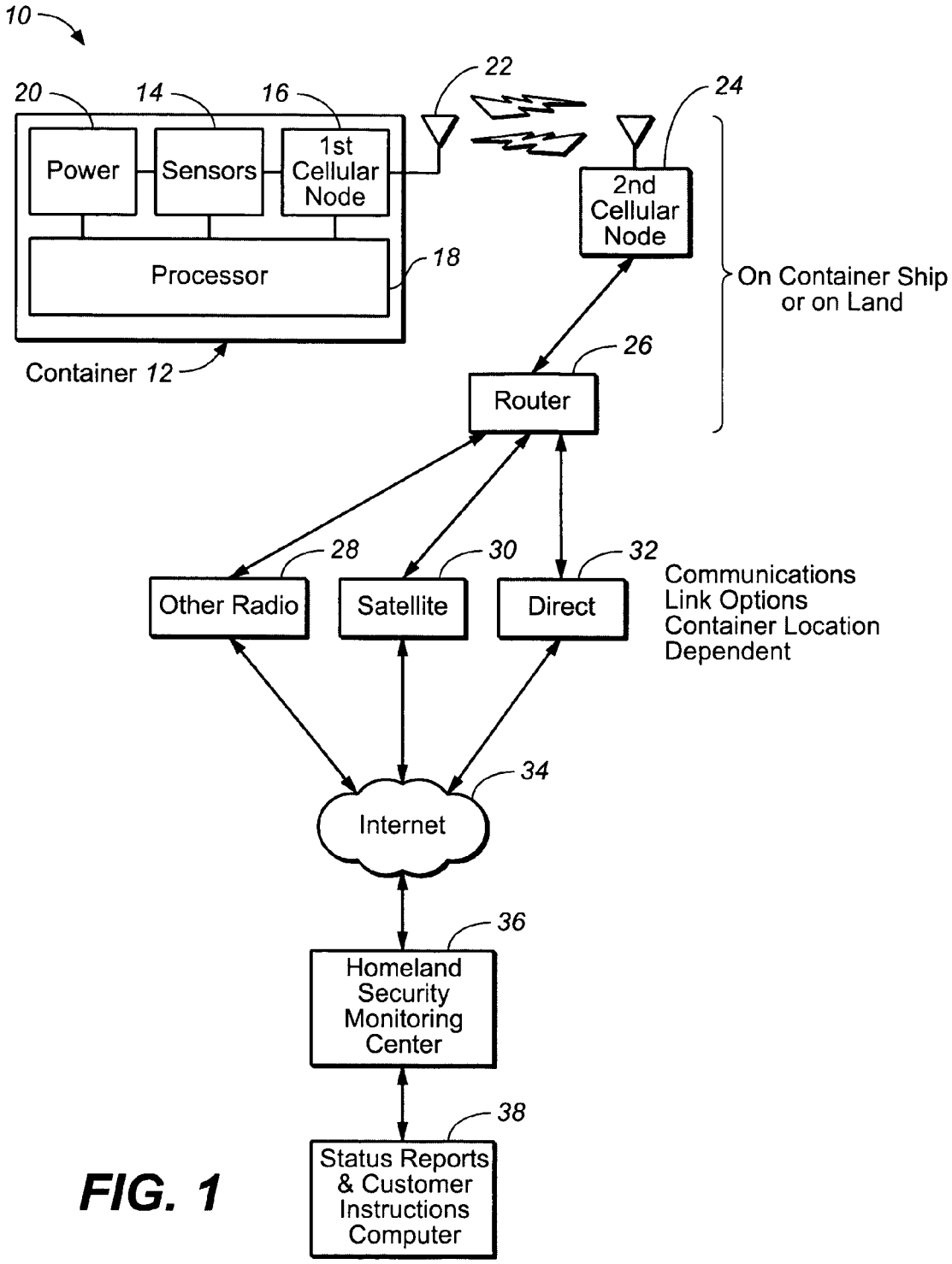
FIG. 1 depicts a system of the present invention for reporting at least one threat to Homeland Security (HS) to at least one Homeland Security Monitoring Center (HSMC).

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

As it is defined in the parent patent application #1, threats are items that are not included on the manifest, because the security system was compromised at some point prior to sealing the container. While this is a necessary condition, it is not a sufficient one for illicit contents to be classified as a threat. To be a threat, undeclared cargo should also represent a significant hazard to the homeland. A package of cocaine would constitute illegal cargo but not a security threat.

It is assumed that each threat is either hidden inside at least one cargo container before transit, or is placed inside at least one cargo container while in transit. It is also assumed that each threat while interacting with its surrounding generates a unique threat signature.

Indeed, a threat hidden inside a cargo container should of necessity interact with its environment. These interactions were collectively referred to in the patent application #1 as signatures. By detecting these interactions, it was possible to identify a threat. The same argument applies to protecting the integrity of a container. All attempts to insert something into a sealed cargo container should of necessity interact with the container.

In the parent patent application #1 a number of sensors for substantially continuously probing each cargo container were disclosed.

The following electromagnetic sensors were disclosed: an active internal 2-D electromagnetic sensor; an active internal 3-D electromagnetic sensor; an active 2-D electromagnetic sensor placed outside the container; an active 3-D electromagnetic sensor placed outside the container; a grid/array of electromagnetic sensor pads placed inside the cargo ship; and a beam-forming grid/array of electromagnetic sensor pads placed inside the cargo ship.

Different technologies suitable for generation such probing electromagnetic signals were also disclosed in the patent application #1 including; a Pulse Width Modulation (PWM) technique; and an AC Signal Injection technique.

In the patent application #1 different sensors configured to detect reflected electromagnetic signals were also disclosed including: a magnetic sensor; a low-field magnetic sensor; a superconducting quantum interference device (SQUID); a Search-Coil; other low-field sensor technologies including nuclear precession, optically pumped, and fiber-optic magnetometer; a flux-gate magnetometer; a magneto inductive magnetometer; a magneto resistive sensor; an AMR magnetic sensor; a Bias Magnetic Field Sensor; a Reed Switch sensor; a Lorentz Force Device; a Hall sensor; a Giant Magnetoresistive (GMR) Device; antiferromagnetic multilayers; a Spin valve; a Spin-dependent tunneling (SDT) structure; a GMR Circuit Technique; and a Smart sensor.

In the patent application #1 the following acoustic sensors were also disclosed: an active internal acoustic 2-D sensor; an active internal 3-D acoustic sensor; an active 2-D acoustic sensor placed outside the container; an active 3-D acoustic sensor placed outside the container; a grid/array of acoustic sensor pads placed inside the cargo ship; and a beam-forming grid/array of acoustic sensor pads placed inside the cargo ship.

The acoustic sensors can be implemented by using piezoelectric substrate materials that can be used for acoustic wave sensors and devices, the most common are quartz ($SiO_2$), lithium tantalate ($LiTaO_3$), and, to a lesser degree, lithium niobate ($LiNbO_3$). In the patent application #1 a number of implementations of acoustic sensors were also disclosed.

In the patent application #1 biosensors configured to detect biological threats and chemical sensors configured to detect chemical threats were also disclosed:

The patent application # 1 also disclosed how to process the detected threat signatures to evaluate the probability of active threats. More specifically, the patent application #1 disclosed the following blocks (not shown): a block for processing each detected threat signature to determine a likelihood of at least one threat to become a threat to the homeland security further comprises, a block for selecting an array of statistically significant threat signatures, and a block for substantially continuously processing the array of selected statistically significant detected threat signatures in order to determine the likelihood of each threat.

The patent application # 1 also disclosed that each container was equipped with a passive radio frequency identification (REID) tag to help to specifically identify which container was a source of at least one active threat to HS.

The patent application # 1 also disclosed that each ship was equipped with at least one mobile robotic means (not shown) that was capable of eliminating at least one threat to HS upon receiving a control signal from the REID tag from the specific container that was deemed to have a high likelihood of being a threat to HS. According to patent application #1, at least one mobile robotic means was capable of taking the necessary steps to eliminate a specific threat to HS emanating from at least one container.

The present invention addresses the issue of reporting each such threat to HS to at least one Homeland Security Monitoring Center (HSMC).

In one embodiment, the system of reporting at least one threat to HS to at least one Homeland Security Monitoring Center (HSMC) of the present invention comprises: (A) a means for substantially continuously probing each cargo container (not shown); (B) a means for detecting at least one threat signature (not shown); (C) a means for processing each detected threat signature to determine a likelihood of at least one threat to become a threat to HS (not shown); (D) a means for identifying at least one container that includes the threat to HS (not shown); (E) a means for reporting to at least one Homeland Security Monitoring Center (HSMC) that at least one container includes at least one threat to HS; and a means receiving instructions from at least one Homeland Security Monitoring Center (HSMC) how to eliminate at least one reported threat to HS while in transit; and (F) a robotic means for eliminating at least one detected threat to HS (not shown).

We focus our discussion of the subsystem (E) a means for reporting to at least one Homeland Security Monitoring Center (HSMC) that at least one container includes at least one threat to HS; and a means receiving instructions from at least one Homeland Security Monitoring Center (HSMC) how to eliminate at least one reported threat to HS while in transit. The means (A), (B), (C), (D), and (F) were disclosed in the parent patent application # 1 and are incorporated by reference herein. In one embodiment of the present invention, FIG. 1 depicts a subsystem (E) 10 of reporting to at least one Homeland Security Monitoring Center (HSMC) that at least one container includes at least one threat to HS; and a means for receiving instructions from at least one Homeland Security Monitoring Center (HSMC) how to eliminate at least one reported threat to HS while in transit.

More specifically, in one embodiment of the present invention, the system 10 further comprises: a processor 18 configured to process a set of threat data generated by each threat to HS, and configured to generate a threat report derived from the set of threat data; a first cellular network 16, a second cellular network 24, a router 26, and an additional forwarding communication networks including a radio network 28, a satellite network 30, and a direct network 32.

In one embodiment of the present invention, each container is equipped with a radio positioning system (not shown) configured to determine position coordinates of at least one container that is a source of at least one detected threat to HS. In one embodiment of the present invention, at least one radio positioning system is selected from the group consisting of: {GPS; GLONASS; and a Global Navigational Satellite System (GNSS)}.

In operation, the system 10 is used to report to at least one Homeland Security Monitoring Center (HSMC) 36 that at least one container includes at least one threat to HS, to receive instructions from at least one Homeland Security Monitoring Center (HSMC) (that receives the instructions from the status report computer 38) how to eliminate at least one reported threat to HS while in transit by using a robotic means (not shown).

In one embodiment of the present invention, the first cellular communication node 16 is configured to initiate a transmission of a message containing the threat report, wherein the second cellular communication node 24 is configured to receive the message and to forward the message to the router 26 for subsequent forwarding via at least one additional communication link (28, 30, or 32) to at least one Homeland Security Monitoring Center (HSMC) 36.

In one embodiment of the present invention, the first cellular communication node 16 is placed on board of the container ship.

In one embodiment of the present invention, the second cellular communication node 24 placed on board of a container ship is used for the purposes of the present invention if the ship is at high seas.

In another embodiment of the present invention, if the ship is approaching a port or a harbor, the second cellular communication node 24 that is located within operating range of a port or harbor is used for the purposes of the present invention.

The router 26 uses at least one additional communication link (a direct link to the Internet 32; a satellite link to the Internet 30; or a private radio link to the Internet 28) to forward the message including the threat report to the Internet.

In one embodiment of the present invention, the satellite link 30 to the Internet further includes: a first transmitter/receiver (not shown) configured to up link the message to a satellite (not shown), and the satellite (not shown) including a second transmitter/receiver (not shown). The second transmitter/receiver is configured to down link the received message from the satellite to the Internet.

In one embodiment of the present invention, the satellite is selected from the group consisting of: {an Inmarsat satellite; a Low Earth-Orbiting Communications Satellite (LEO); and a Geosynchronous Communications Satellite (GEO)}.

In one embodiment of the present invention, the second cellular communication node 24 is a part of a data cellular network, like Aeris.net. Aeris.net is a San Jose Calif. company making a product and offering a service to customers with a need for delivering small amounts of status data from any monitoring system to a customer by using a 48-bit message space available within the cellular control channel protocol data message. This is so called "M2M" or machine to machine communications service. No humans are involved until the data is displayed to a customer, or until a receiving machine decides that a human should have a look at the data. For the purposes of the present invention, the second communication node 24 can be implemented by Aeris.net data communication system. Aeris.net data communication system can be also used to connect the HSMC center to status report computer 38 that can also generate the set of instructions for robotic means how to eliminate the detected threats. Since the Aeris.net cellular system is bi-directional, this set of instructions can be sent to the ship processor 18 by using the reverse route: from HSMC 36 via the Internet, via the additional communication network, via the second communication node 24, and finally via the first communication node 16 to the processor 18.

Seamless connectivity is possible by arranging to put an Aeris.net compatible equivalent of a cellular base station on board the cargo ship. It is seamless since the Aeris.net cellphone can work with the local cellular base station when no other base station is within communications range, and can be configured to contact on-land base stations as the cargo ship approaches land or a harbor.

In another embodiment of the present invention, the second cellular communication node 24 is a part of a voice/data cellular network, like a SeaMobile™ located in Seattle. SeaMobile offers the flexible network for offshore platform workers. SeaMobile flexible network can be also used for the purposes of the present invention.

The foregoing description of specific embodiments of the present invention has been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. Therefore, it is intended that the scope of the invention be defined by the claims appended hereto and their equivalents, rather than by the foregoing description. All changes which come within the meaning and range of equivalency of the claims are to be embraced within their scope.

What is claimed is:

1. A method for reporting at least one detected active threat to the homeland security (HS);—each said threat being hidden inside at least one cargo container before transit; each said threat while interacting with internal borders of said cargo generates a unique threat signature; said method comprising:

(A) substantially continuously actively probing each said cargo container to detect at least one said threat either being hidden inside said cargo container before transit;

(B) detecting at least one said threat signature;

(C) processing each said detected threat signature to determine a likelihood of at least one said threat to become a threat to HS;

(D) identifying at least one said container that includes said threat to HS;

(E) reporting to at least one Homeland Security Monitoring Center (HSMC) that said at least one container includes said at least one threat to HS; and receiving instructions from said at least one Homeland Security Monitoring Center (HSMC) how to eliminate at least one said reported threat to HS while in transit;

and (F) using robotic means to eliminate said at least one detected threat to HS.

2. The method of claim 1, wherein said step (E) further comprises:

(E1) processing a set of threat data generated by each said threat to HS; wherein said set of threat data includes position coordinates of each container including at least one said threat to HS;

(E2) generating a threat report derived from said set of threat data;

(E3) sending said threat report to said at least one Homeland Security Monitoring Center (HSMC);

and (E4) receiving a set of instruction from said at least one Homeland Security Monitoring Center (HSMC) how to eliminate said at least one detected threat to HS.

3. The method of claim 2, wherein said step (E1) further comprises:

(E1, 1) determining position coordinates of at least one said container including at least one said threat to HS by using a radio positioning system; wherein said radio positioning system is selected from the group consisting of: GPS; GLONASS; and Global Navigational Satellite System (GNSS).

4. The method of claim 2, wherein said step (E3) further comprises:

(E3, 1) using a first cellular node configured to initiate a transmission of a message containing said threat report;

and (E3, 2) using a second cellular communication node configured to receive said message and to forward said message to a router for subsequent forwarding via at least one additional communication link to said at least one Homeland Security Monitoring Center (HSMC).

5. The method of claim 4, wherein said step (E3, 1) further comprises:

(E3, 1, 1) using a message that contains an identifier and a destination address.

6. The method of claim 5, wherein said step (E3, 2, 2) further comprises:

(E3, 2, 2, 2) using said satellite link to the Internet; wherein said satellite link to the Internet further includes a first transmitter/receiver configured to up link said message to a satellite; and wherein said satellite link to the Internet further includes said satellite including a second transmitter/receiver; and wherein said second transmitter/receiver is configured to down link said received message from said satellite to the Internet.

7. The method of claim 6, wherein said step (E3, 2, 2, 2) further comprises:

(E3, 2, 2, 2, 1) selecting said satellite from the group consisting of: {an Inmarsat satellite; a Low Earth-Orbiting Communications Satellite (LEO); and a Geosynchronous Communications Satellite (GEO)}.

8. The method of claim 4, wherein said step (E3, 1) further comprises:

(E3, 1, 2) placing said first cellular communication node on board of said container ship.

9. The method of claim 4, wherein said step (E3, 2) further comprises:

(E3, 2, 1) using said router to access said at least one additional communication link for forwarding said message to said at least one Homeland Security Monitoring Center (HSMC) via the Internet.

10. The method of claim 4, wherein said step (E3, 2) further comprises:

(E3, 2, 2) selecting at least one said additional communication link from the group consisting of: a direct link to the Internet; a satellite link to the Internet; and a private radio link to the Internet.

11. The method of claim 10, wherein said step (E3, 2, 2) further comprises:

(E3, 2, 2, 1) selecting said direct link to the Internet from the group consisting of: a dial-up terrestrial telephone link; a DSL terrestrial telephone link; and a cable TV terrestrial data link.

12. The method of claim 4, wherein said step (E3, 2) further comprises:

(E3, 2, 3) placing said second cellular communication node on board of said container ship.

13. The method of claim 4, wherein said step (E3, 2) further comprises:

(E3, 2, 4) using a second cellular communication node that is located within operating range of a port or harbor.

14. The method of claim 4, wherein said step (E3, 2) further comprises:

(E3, 2, 5) using a second cellular communication node that is a part of a data cellular network.

15. The method of claim 4, wherein said step (E3, 2) further comprises:

(E3, 2, 6) using a second cellular communication node that is a part of a voice/data cellular network.

16. A system for reporting at least one detected active threat to the homeland security (HS); each said threat being hidden inside at least one cargo container before transit, each said threat while interacting with internal borders of said cargo generates a unique threat signature; said system comprising:

(A) a means for substantially continuously probing each said cargo container to detect at least one said threat either being hidden inside said cargo container before transit;

(B) a means for detecting at least one said threat signature;

(C) a means for processing each said detected threat signature to determine a likelihood of at least one said threat to become a threat to HS;

(D) a means for identifying at least one said container that includes said threat to HS;

(E) a means for reporting to at least one Homeland Security Monitoring Center (HSMC) that said at least one container includes at least one said threat to HS; and receiving instructions from said at least one Homeland Security Monitoring Center (HSMC) how to eliminate said at least one reported threat to HS while in transit;

and (F) a robotic means for eliminating said at least one detected threat to HS.

17. The system of claim 16, wherein said means (E) further comprises:

(E1) a means for a processing a set of threat data generated by each said threat to HS; wherein said set of threat data includes position coordinates of each container including at least one said threat to HS;

(E2) a means for generating a threat report derived from said set of threat data;

(E3) a means for sending said threat report to said at least one Homeland Security Monitoring Center (HSMC);

and (E4) a means for receiving a set of instruction from said at least one Homeland Security Monitoring Center (HSMC) how to eliminate said at least one detected threat to HS.

18. The system of claim 17, wherein said means (E1) further comprises:

(E1, 1) a radio positioning system configured to determine position coordinates of at least one said container including said at least one detected threat to HS; wherein said radio positioning system is selected from the group consisting of: GPS; GLONASS; and a Global Navigational Satellite System (GNSS).

19. The system of claim 17, wherein said means (E3) further comprises:

(E3, 1) a first cellular communication node configured to initiate a transmission of a message containing said threat report;

and (E3, 2) a second cellular communication node configured to receive said message and to forward said message to a router for subsequent forwarding via at least one additional communication link to said at least one Homeland Security Monitoring Center (HSMC).

20. The system of claim 19, wherein said additional communication link is selected from the group consisting of: a direct link to the Internet; a satellite link to the Internet; and a private radio link to the Internet.

* * * * *